United States Patent [19]

Ke-hui

[11] Patent Number: 4,949,999

[45] Date of Patent: Aug. 21, 1990

[54] BOOK INDEXING SYSTEM

[76] Inventor: Cui Ke-hui, 1630 N. W. 2nd Avenue, Gainesville, Fla. 32603

[21] Appl. No.: 197,167

[22] Filed: May 23, 1988

[51] Int. Cl.[5] ..... B42F 21/00; B42F 21/04; B42F 21/08; B42F 21/02

[52] U.S. Cl. ..... 283/38; 283/36; 283/40; 283/42

[58] Field of Search ..... 283/37, 38, 3, 39, 40, 283/41, 48, 43, 36, 42, ; 209/547; 364/400; 40/360, 361

[56] References Cited

U.S. PATENT DOCUMENTS

| | | | |
|---|---|---|---|
| 2,369,173 | 2/1945 | Oppenheimer | 283/42 |
| 2,680,630 | 6/1954 | Machol | 283/38 |
| 4,300,791 | 11/1981 | Bohrer et al. | 283/38 |

FOREIGN PATENT DOCUMENTS

| | | | |
|---|---|---|---|
| 682908 | 6/1966 | Belgium | 283/42 |
| 1147561 | 4/1963 | Fed. Rep. of Germany | 283/42 |
| 1187224 | 2/1965 | Fed. Rep. of Germany | 283/42 |
| 202258 | 1/1939 | Switzerland | 283/42 |
| 1801 | 5/1877 | United Kingdom | 283/40 |
| 2068839 | 8/1981 | United Kingdom | 283/38 |

*Primary Examiner*—Frank T. Yost
*Assistant Examiner*—Paul M. Heyrana, Sr.

[57] ABSTRACT

An indexing system for a reference book which is printed on the edge of the pages opposite to the binding so as to be visual when the book is closed; the system including primary, secondary, and further subdivided portions of the book identified by large letters, succeedingly smaller letters, and color coded marks to represent respective portions of the book where the contents relate to words having a first letter corresponding to the large letters, a second letter corresponding to the next smaller letter, and a third and succeeding letters represented by still smaller letters or a color coded mark.

12 Claims, 4 Drawing Sheets

BOOK INDEXING SYSTEM

BACKGROUND OF THE INVENTION

Reference books, such as dictionaries, encyclopedias, catalogues, atlases, telephone books, text books, and the like, are frequently indexed in some fashion that makes it easier to open the book near to the page being sought. A frequently used system is to provide finger tip recesses in the edges of the pages when the book is closed with a large letter printed in the recess to show where words beginning with that letter are found. In other instances, there are no recesses for feel by the finger tips, but large letters are printed on the surface formed by the closed adjoining edges of the book pages to show approximately where to open the book. These indexing systems, however, only provide an approximate indication of where to open the book, and may leave the user with 50–100 pages or more to be searched through in order to find the word actually sought.

It is an object of this invention to provide an improved visual indexing system to be printed on the adjoining edges of the book pages. It is another object of this invention to provide a visual indexing system that provides a much more accurate means of locating the page sought in a reference book, such as a dictionary. Still other objects will become apparent from the more detailed description which follows.

BRIEF SUMMARY OF THE INVENTION

This invention relates to an indexing system for books having contents arranged alphabetically or numerically, comprising symbols and colored marks imprinted on the edges of the pages opposite to the binding such that said letters and marks are visually identifiable when said book is closed; the system including:

(a) major symbols of a size to extend laterally substantially from the first page to the last page of contents relating to that symbol;

(b) minor symbols, positioned vertically below each appropriate major symbol, of a size to extend laterally substantially from the first page to the last page of contents relating to said major symbol and said minor symbol;

(c) subminor symbols, positioned vertically below each appropriate minor symbol, of a size to extend laterally substantially from the first page to the last page of contents relating to said major symbol, said minor symbol and said subminor symbol; and (d) vertical marks positioned vertically below each appropriate said symbol whether it be major, minor, or subminor, of a size to extend laterally substantially from the first page to the last page of contents relating to the combination of all symbols vertically above said mark, and including said mark; said marks being colored any of a selected plurality, preferably five, of colors defined to represent the entire spectrum of logical subdivisions of the symbol to which it pertains.

In specific and preferred embodiments of the invention the book is a dictionary or encyclopedia, and the indexing symbols are letters of the alphabet, with smaller size letters representing first and second subdivisions of each larger letter, and where color coded vertical marks represent smaller subdivisions in which the number of pages involved is too small in width to permit the printing of a visually recognizable letter therein.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The indexing system of this invention can best be understood by reference to the accompanying drawings.

Figure 1A:
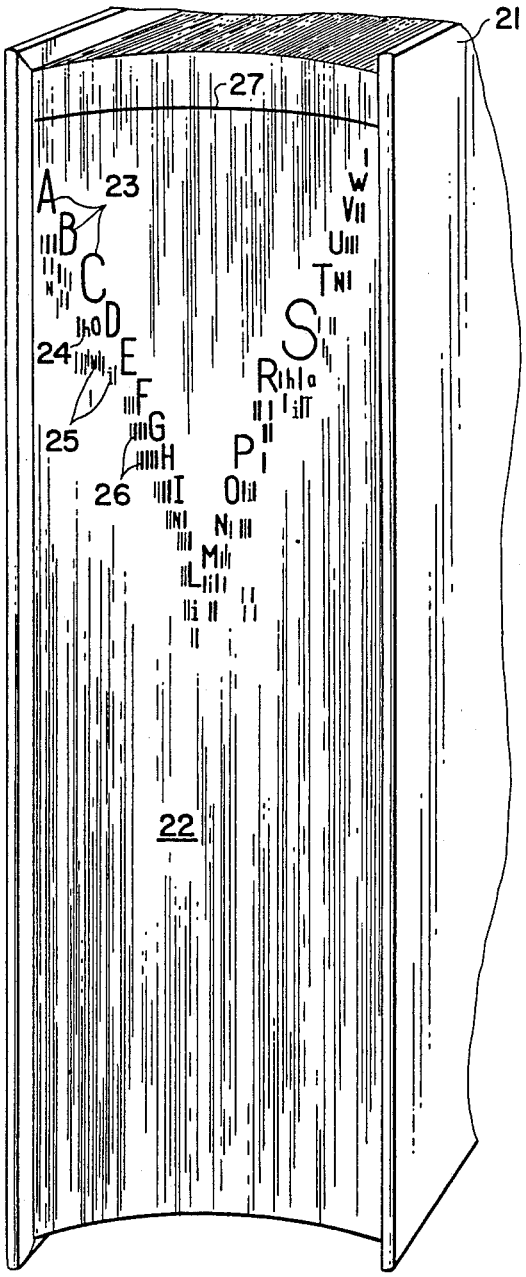
FIG. 1A is a perspective view of the edges of the pages of a closed book employing the indexing system of this invention.
Figure 1B:
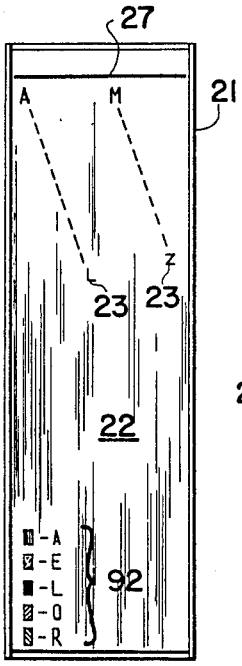
FIG. 1B is a second embodiment of the system of FIG. 1A.
Figure 1C:
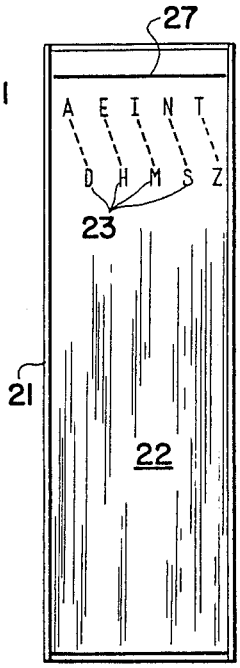
FIG. 1C is a third embodiment of the system of FIG. 1A.
Figure 1D:
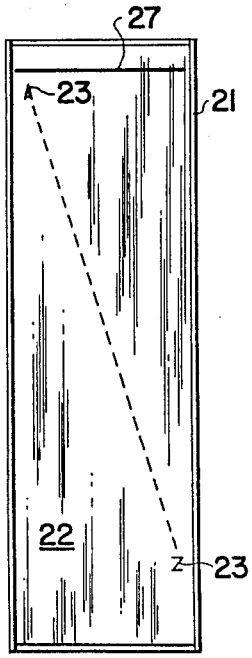
FIG. 1D is a fourth embodiment of the system of FIG. 1A.
Figure 2:
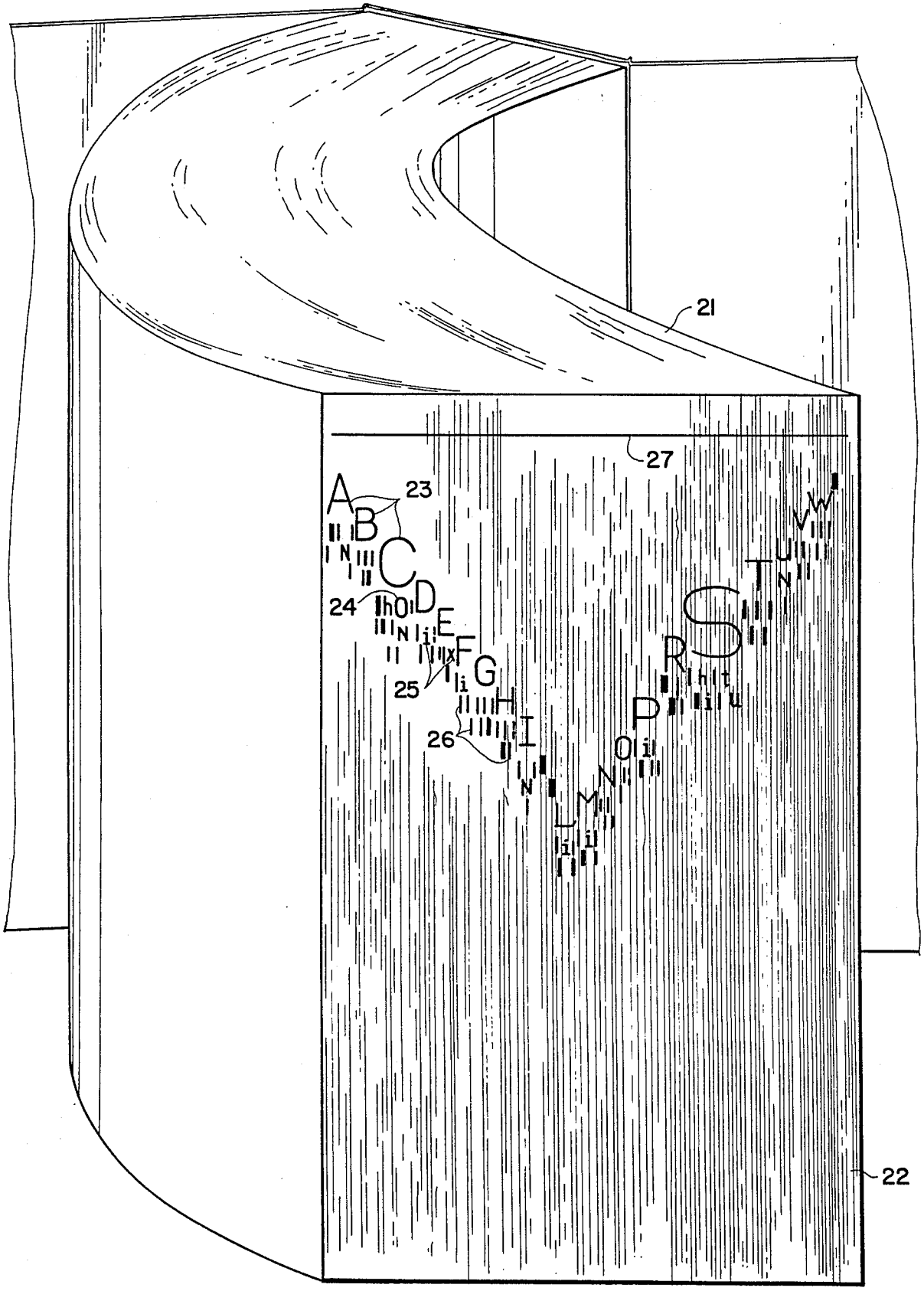
FIG. 2 is a view similar to that of FIG. 1A with the book pages flexed to provide better visual identification of the indexing system.

In FIGS. 1A and 2 there is shown a book 21 in a closed position with page edges 22 on the side opposite to the bindings forming a curved surface on which are printed a plurality of symbols including letters of the alphabet and color coded vertial marks. The primary symbols 23 are large capital letters arranged in alphabetical order forming a V-shape from A on the upper left to L at the lower midpoint to a vertical mark at the upper right. The secondary symbols 25 are smaller letters of different sizes. The other symbols 26 are color coded vertical lines or bars. By understanding the system these symbols will permit one to open the book to a page very close to the one sought and thus save the time of turning several pages to reach the ultimate destination. FIG. 2 shows the same arrangement as that of FIG. 1 except that book 21 is opened slightly to permit the pages to be flexed and thereby to make it easier to visually distinguish one symbol from another and thus provide a more accurate selection of the page to be chosen.

In FIGS. 1B, 1C, and 1D there are shown embodiments for arranging primary symbols 23 other than in the shape of a V. In FIG. 1B the primary symbols 23 are in two sloping approximately parallel line rather than in the shape of a V. In FIG. 1C symbols 23 are in five shorter sloping approximately parallel lines rather than in two longer approximately parallel lines as in FIG. 1B. In FIG. 1D the primary symbols are in one long sloping line. Also in FIG. 1B there is shown a typical color code legend 92 to be used to remind the user of the meanings of the several colors.

Figure 3:
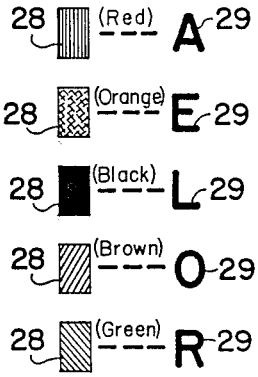
FIG. 3 is an illustration of the five preferred color codes and the letter to which color refers.

In FIG. 3 there is shown five colors 28 and a corresponding five letters 29 representing the meaning for each color. The colors 28 are intended to represent portions of the alphabet. For example red means the letter A, orange means the letter E, black means the letter L, brown means the letter 0, and green means the letter R. It is, of course, to be understood that this part of the system is subject to other selections of portions of the alphabet. There may be more or less than five colors 28, and there may be other letters of the alphabet 29 assigned to each color as chosen by the user.

A horizontal base line 27 (as shown in FIGS. 1 and 2) is printed above the arrangement of symbols 23, 24, 25, and 26 and is used to assist the printer to properly locate each symbol. The printing may be controlled by a computer and the base line 27 is particularly important in such a case. Each individual symbol can be precisely located by measurement horizontally from each end of the base line 27 and vertically downward from base line 27.

Figure 4:
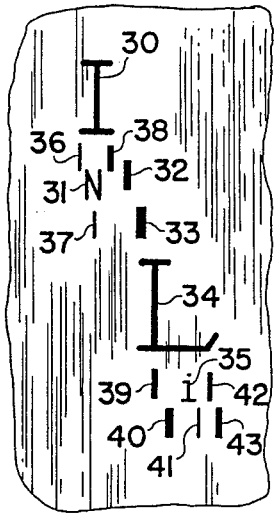
FIG. 4 is an enlarged view of one portion of the indexing system relating to I, J, K, and L.

Examples of the logic of the indexing system is shown in FIGS. 4–8. In FIG. 4 there are shown as primary symbols the letter I 30, black bars 32 and 33, and the letter L 34. Bar 32 represents the letter J. Bar 33 represents the letter K. Each of these primary symbols is of size laterally to extend over all of the pages which contain contents which are identified by a word or expression beginning with that letter. Thus if the book is a dictionary, the symbol 30 extends laterally over all pages in which words begin with the letter I. In the case of a telephone book the symbol 30 would be printed on the edge of all pages where the names of persons and companies began with the letter I. The symbols 32 and 33 are merely bars because the lateral width of the pages relative to J and K respectively is too narrow to permit printing a J or K that would be visually recognizable. A similar symbol is used for other letters, such as Q, which do not represent many words.

Vertically below the primary symbols 30, 32, 33, and 34 are secondary symbols and further subdivisional symbols. The smaller letter N 31 is a secondary symbol and shown by its lateral width all pages where the first two letters of the contents are in. No other combination of I with a second letter extends through enough pages to use a different second letter than N, and therefore, the further subdivisional symbols are color coded vertical marks. Mark 36 is black and represents the pages where the contents begin with the combination Il. Black mark 37 is subsidiary to symbol 31 because it is placed vertically below N and represents contents having the first three letters Inl. Green mark 38 represents contents where the first two letters are Ir.

Under the letter L is a secondary symbol i 35 and marks 39, 40, 41, 42, and 43. Symbol 35 is printed on those pages wherein the contents of the pages relate to words beginning with the letters Li. Symbol 39 is red and indicates pages where the contents begin with the letters La. Symbol 40 is orange and indicates pages where the contents begin with the letter Le. Symbol 41 is black and indicates pages where the contents begin with the letters Ll. Symbol 42 is brown and indicates those pages where the contents begin with the letters Lo. Symbol 43 is green and indicates those pages where the contents begin with the letters Lr.

Figure 5:
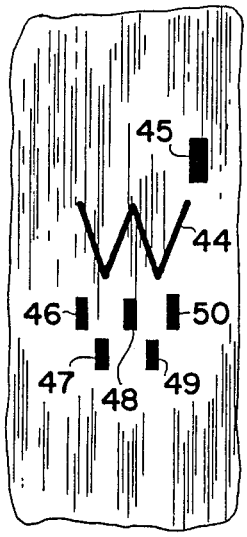
FIG. 5 is an enlarged view of a second portion of indexing system relating to W, X, Y, and Z.

In FIG. 5 there are shown the last two primary symbols in the alphabet, W 44 and black bar 45 representing X, Y, and Z. Under W 44 are the five colored secondary marks 46, 47, 48, 49, and 50. Symbol 46 is red and represents Wa. Symbol 47 is orange and represents We. Symbol 48 is black and represents Wl. Symbol 49 is brown and represents Wo. Symbol 50 is green and represents Wr.

Figure 6:
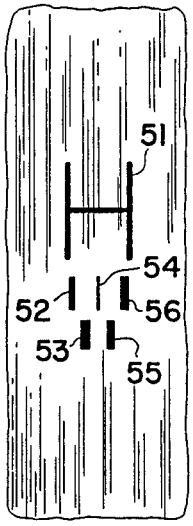
FIG. 6 is an enlarged view of a third portion of the indexing system relating to H.

In FIG. 6 there is the primary symbol H 51 and secondary symbols 52, 53, 54, 55, and 56. Symbol 52 is red and represents Ha. Symbol 53 is orange and represents He. Symbol 54 is black and represents Hl. Here there might be a variation in the general rules of assigning certain portions of the alphabet to certain letters. Since there are only a few words beginning with Hl, black mark 54 may be positioned to cover at least some of the pages with contents beginning with Hi. Symbol 55 is brown and represents Ho. Symbol 56 is green and represents Hr.

Figure 7:
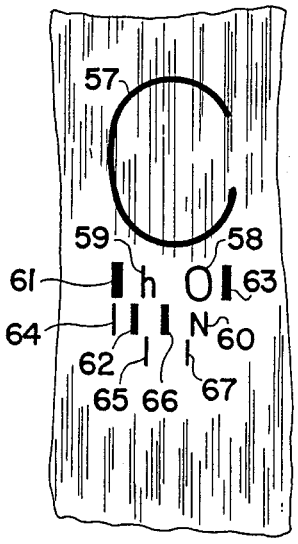
FIG. 7 is an enlarged view of a fourth portion of the indexing system relating to C.

In FIG. 7 there are shown symbols representing perhaps the most complicated combination that one might expect. Primary symbol C 57 has two secondary symbols in the form of letters, H 59 and O 58; a tertiary symbol in the form of letter N 60, and a variety of marks and bars as symbols 61, 62, 63, 64, 65, 66, and 67. Symbol 59 indicates pages where the contents begin with Ch. Symbol 65 is a black mark vertically below symbol 59 and represents contents beginning with the letters Chl. Symbol 58 represents pages where the contents begin with Co. Symbol 60 is the letter N vertically below symbol 58 and, therefore, represents pages on which the contents begin with Con. Symbol 67 is black mark vertically below symbol 58 but not below symbol 60. Symbol 67, therefore, represents pages where the contents begin with the combination Col. If there were enough pages where the contents begin with Cona, there would be a red mark vertically below symbol 60. Symbol 61 is a red mark representing Ca. Symbol 64 is a black mark vertically below symbol 61 and represents Cal. Symbol 62 is an orange mark representing Ce. Symbol 66 is a black mark representing Cl. Symbol 63 is a green mark representing Cr. There is no brown mark which would normally represent Co, since there were enough words beginning with Co to employ secondary symbol O 58.

Figure 8:
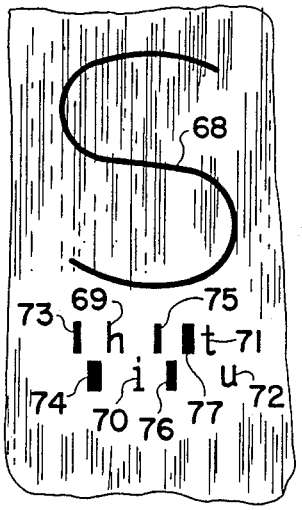
FIG. 8 is an enlarged view of a fifth portion of the indexing system relating to S.
Figure 9:
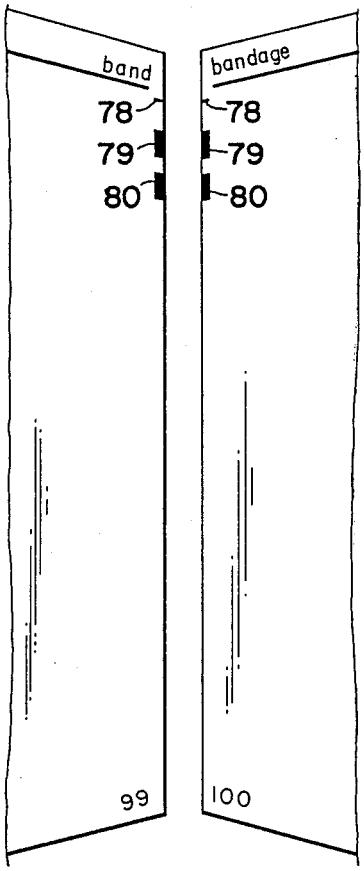
FIG. 9 is a schematic illustration of two adjoining pages relating to words "band" and "bandage" printed with the indexing system of this invention.

In FIG. 8 there is shown the primary symbol S 68 and the subsidiary symbols 69–77 relating thereto. Symbol 73 is a red mark representing Sa. Symbol 74 is an orange mark representing Se. Symbol 69 is the letter H representing Sh. Symbol 70 is the letter i representing Si. Symbol 75 is a black mark representing Sl. Symbol 76 is a brown mark representing So. Symbol 77 is a green mark representing Sr. Symbol 71 is the letter T representing St. Symbol 72 is the letter u representing Su.

The method of printing the indexing system on the edges of pages is shown in FIGS. 9–14. Preferably the printing is controlled by a computer so that the minute marks printed on each page will fit together with marks on adjacent pages to produce a recognizable symbol when the several adjacent pages are pressed together and viewed from edgewise. Generally the symbols on each page are printed about 2–3 mm. wide so as to spread out the marks when the pages are flexed as shown in FIG. 2. While the indexing system of this invention appears on the open edge of the book, it is preferable for the symbols to be printed on the pages rather than on the edges of the pages after the book is assembled. Vertical bars and lateral lines at the appropriate location on each page are printed about 2–3 mm. wide by computerized locations. When assembled, these vertical bars and lateral lines will appear as letters and symbols as shown in FIGS. 1A and 2. Each page has portions of base line 27 printed thereon, and subsequent assembly by aligning base line 27 will cause all symbols to be recognizable. Marks on each page will come together to form a symbol. As an example in FIG. 9 there are shown the two sides of a single sheet of paper comprising pages 99 and 100 of a dictionary where the words on page 99 end with the word "band" and the words on page 100 begin with the word "bandage". Two thin lateral lines 78 are needed near the top of the page at the outer edge for base line 27 (see FIGS. 1–2). The two black bars 79 on each page represent a slice of the vertical leg of the letter B. The two red bars 80 represent a slice of the red secondary symbol placed vertically below B to represent words beginning with Ba. The bars 79 and 80 are printed symmetrically on the two adjoining pages as are other symbols described below with respect to FIGS. 10–12. This general principle makes the printing problems easier by making facing pages to be printed identically the same.

Figure 10:
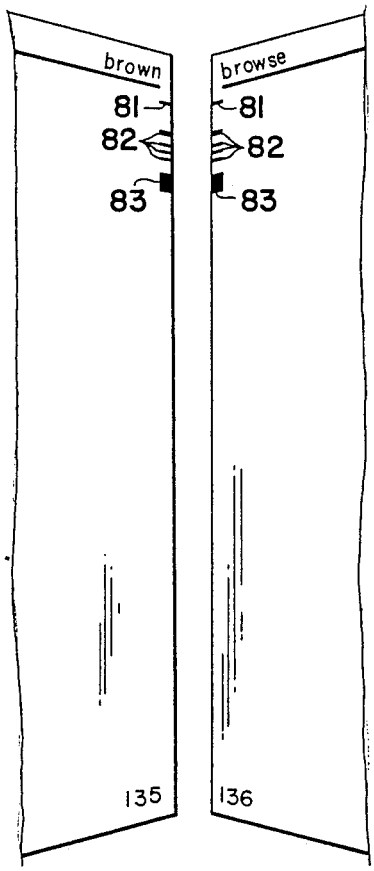
FIG. 10 is a schematic illustration of another adjoining two pages relating to words "brown" and "browse" printed with the indexing system of this invention.

In FIG. 10 there are shown two adjoining pages still under the primary symbol B but further along in the alphabet for the second letter. Page 135 ends with the word "brown" and page 136 begins with the word "browse". Lines 81 are part of base line 27 (see FIGS. 1–2). Four horizontal black lines 82 on each page represent a slice through the two curved portions of the primary symbol B. Green bars 83 represent slices of the secondary symbol (green mark) representing words beginning with Br.

Figure 11:
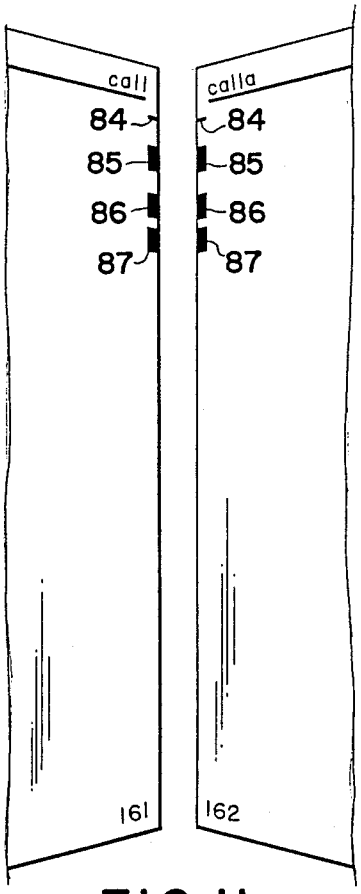
FIG. 11 is a schematic illustration of still another two adjoining pages relating to the words "call" and "calla" printed with the indexing system of this invention.

In FIG. 11 there are shown pages 161 and 162 with the word "call" ending page 161 and the word "calla" beginning page 162. See FIG. 7 and its description for a more complete understanding of FIG. 11. Lines 84 represent a portion of base line 27. Marks 85 represent a slice through the left side of the primary symbol C (57 of FIG. 7). Red bars 86 represent a slice through the left side of the secondary symbol a (red mark 61 of FIG. 7). Black bars 87 represent a slice through the tertiary symbol (black mark 64 of FIG. 7), representing Cal.

Figure 12:
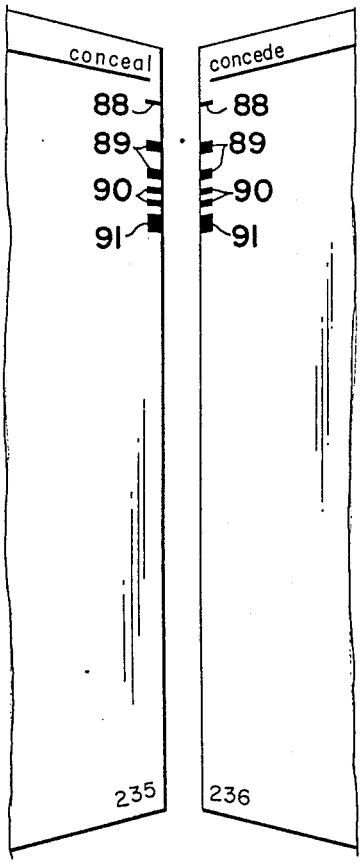
FIG. 12 is a schematic illustration of yet another two adjoining pages relating to the words "conceal" and "concede" printed with the indexing system of this invention.

In FIG. 12 there are shown pages 235 and 236 with the word "conceal" being the last word on page 235 and the first word on page 236 being "concede". See FIG. 7 and its description for a more complete understanding of FIG. 12. Black lines 88 are portions of base line 27. Two black horizontal bars 89 on each page represent a vertical slice through the middle of the primary symbol C. The next two thin horizontal black bars 90 on each page represent a vertical slice through secondary symbol o (58 of FIG. 7) vertically below primary symbol C. The next vertical black bars 91 represent a slice through the left vertical leg of the tertiary symbol n (60 of FIG. 7) positioned vertically below secondary symbol o.

Figure 13A:
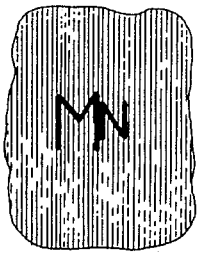
FIG. 13A is an enlarged view showing the disadvantages of printing successive letters on a horizontal line.
Figure 13B:
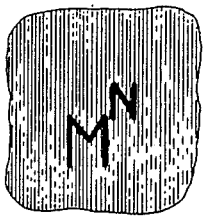
FIG. 13B is an enlarged view showing the advantages of printing successive letters on an inclined line.

In FIG. 13A there is shown the undesirable result of printing primary symbols M and N horizontally across the edges of the pages of a book. The vertical right leg of !1 and the vertical left leg of N would merge and make it difficult to open the book at the beginning of the words under N. In FIG. 13B it is shown that the same two primary symbols are easily delineated when the primary symbols are printed in an inclined fashion in the shape of a V as shown in FIGS. 1A and 2 or in any of the sloping fashions shown in FIGS. 1B, 1C or 1D. The rise of such sloping directories is preferred, particularly the V-shape of FIGS. 1A and 2. For the same reason of rapid visual delineation, the secondary and tertiary symbols should be placed on different levels under the primary symbols.

Figure 14:
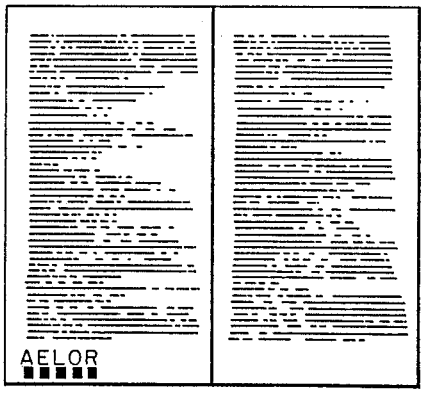
FIG. 14 is an illustration of how the preferred color code can be printed on a page as a reminder legend.

In FIG. 14 there is shown the preferred procedure of printing the color code of FIG. 3 on at least every second page of the book so that the code is visible regardless of the pages where the book is opened.

It is reiterated that the use of base line 27 is important in printing, with or without the assistance of a computer so as to provide a common measuring point for determining exactly where to print portions of symbols on each page such as bars 89, 90, and 91 in FIG. 12.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to be secured by Letters Patent of the United States is:

1. An indexing system for books having contents arranged alphabetically or numerically, comprising symbols and colored marks imprinted on the edges of the pages opposite the binding such that said symbols and marks are visually identifiable when said book is closed; the system including:

(a) primary symbols of a size to extend laterally substantially from the first page to the last page of contents relating to that symbol;

(b) secondary symbols, positioned vertically below each appropriate primary symbol, of a size to extend laterally substantially from the first page to the last page of contents relating to said primary symbol and said secondary symbol;

(c) tertiary symbols, positioned vertically below each appropriate secondary symbol, of a size to extend laterally substantially from the first page to the last page of contents relating to said primary symbol, said secondary symbol, and said tertiary symbol; and (d) vertical marks positioned vertically below each appropriate said symbol, whether it be primary, secondary, or tertiary, of a size to extend laterally substantially from the first page to the last page of contents relating to the combination of all symbols vertically above said mark, and including said mark; said marks being colored any one of a selected plurality of colors defined to represent the entire spectrum of logical subdivisions of the symbol to which it pertains.

2. The system of claim 1 wherein each said symbol and said mark represents a letter or combination of letters of an alphabet.

3. The system of claim 2 wherein said letters consist of the 26 letters from A to Z.

4. The system of claim 1 wherein each said symbol and said mark represents a number or combination of numbers of a numbering system.

5. The system of claim 4 wherein said numbering system consists of numbers 1, 2, 3, 4, 5, 6, 7, 8, 9, and 0.

6. The system of claim 2 wherein a red mark relates to the letter A; an orange mark relates to the letter E; a black mark relates to the letter L; a brown mark relates to the letter O; and a green mark relates to the letter R.

7. The system of claim 1 wherein said primary symbols are arranged in the sloping fashion of the letter V across said edges of pages of the closed book.

8. An indexing system for books having contents arranged alphabetically comprising letters of an alphabet and colored vertical marks printed on the edges of the pages opposite to the binding of said book to function as visually recognizable symbols when the book is closed to facilitate opening the book to a selected location; said system including:

(a) as a primary symbol a capital letter of the alphabet or a symbol representing a capital letter, each being of a size to extend laterally from the first page to the last page of contents defined by a word or expression where the first letter of said word or expression is said respective capital letter;

(b) as a secondary symbol, where appropriate, a letter positioned vertically below said primary symbol and of a size to extend laterally from the first page to the last page of said words or expressions which have as a first letter said primary symbol and as a second letter said secondary symbol;

(c) a tertiary symbol where appropriate, a letter positioned vertically below said secondary symbol and of a size to extend laterally from the first page to the last page of said words or expressions which have as a first letter said primary symbol, as a second letter said secondary symbol, and as a third letter said tertiary symbol, respectively; and (d) short vertical marks each of a selected color each said mark representing the appropriate said symbol where the number of pages of the represented word or expression is too small to provide a lateral space large enough to permit printing of the appropriate said symbol thereon; or to represent the fourth letter in a word where said tertiary symbol positioned vertically above said mark represents the third letter in said word; said selected color being one of a plurality of colors in a color code wherein each color represents a portion of the alphabet.

9. The system of claim 8 wherein said primary symbols are arranged in the shape of the letter V on said edges opposite to the binding.

10. The system of claim 8 wherein said color code comprises five easily distinguishable colors each representing a sequence of letters of the alphabet.

11. The system of claim 10 wherein said sequences are a-d, e-k, l-n, o-p, and r-z.

12. The system of claim 1 when used with a computer controlled program to position the printing of one or more markings on each page of the book adjacent its edge opposite to the binding edge, such that when assembled the open edges of the closed book will exhibit said indexing system thereon, which includes establishing a common base line adjacent the top of each page and across the edges of all closed pages to facilitate the positioning of said markings by measurement from said base line.

* * * * *